United States Patent [19]

Savkar

[11] Patent Number: 4,714,198

[45] Date of Patent: Dec. 22, 1987

[54] DUAL FUEL SINGLE INJECTOR NOZZLE

[75] Inventor: Sudhir D. Savkar, Schenectady, N.Y.

[73] Assignee: General Electric Company, Schenectady, N.Y.

[21] Appl. No.: 937,246

[22] Filed: Dec. 3, 1986

[51] Int. Cl.[4] ..... B05B 7/12

[52] U.S. Cl. ..... 239/409; 239/410; 239/415; 239/417

[58] Field of Search ..... 239/410, 416, 411, 409, 239/408, 417, 417.3, 415, 533.1–533.12

[56] References Cited

U.S. PATENT DOCUMENTS 1,521,389 12/1924 Pielstick ..... 239/408

1,586,006 5/1926 Rochefort ..... 239/410

*Primary Examiner*—Andres Kashnikow

*Assistant Examiner*—Karen B. Merritt

*Attorney, Agent, or Firm*—William H. Steinberg; James C. Davis, Jr.; Paul R. Webb, II

[57] ABSTRACT

An injector nozzle is provided which provides a pilot charge of fuel followed by a charge of coal/water slurry. The injector nozzle has a valve which is moved by coal/water slurry pressure to introduce pilot fuel followed by coal/water slurry. After the coal/water slurry is introduced the valve and valve seat are purged by pilot fuel.

5 Claims, 4 Drawing Figures

DUAL FUEL SINGLE INJECTOR NOZZLE

BACKGROUND OF THE INVENTION

The present invention relates to dual fuel single injector nozzles for use with coal fired diesels.

In coal fired diesels it is desirable to provide as the first charge in a cycle a small quantity of diesel fuel referred to as the pilot charge. The pilot charge fires very quickly increasing chamber pressure and temperature resulting in more rapid ignition of the coal/water slurry injected immediately following the pilot charge. Presently, a separate injector can be provided for injecting pilot fuel and a separate coal/water slurry injector can be provided to add the slurry. A stratified single nozzle injector can alternatively be used. A stratified single nozzle injector has coal/water slurry and pilot fuel in the same chamber of the injector with the coal/water slurry and fuel oil separating or stratifying. When the pilot fuel and slurry are injected into the combustion chamber, pilot fuel is in the lower portion of the chamber and is introduced first into the combustion chamber. The performance of the stratified charge injector is better than that of the separate pilot fuel and coal/water slurry injectors because of the better heating of the coal/water slurry which is delivered to the same spray pattern location as the previously ignited pilot fuel. However there are several drawbacks to stratified charge nozzles. The main problem is that over time wear in the moving parts of the nozzle caused by the coal/water slurry increases the amount of pilot fuel introduced with each firing and control over the ratio of pilot fuel to coal/water slurry is lost.

It is an object of the present invention to provide a dual fuel single injector nozzle for use with slurry fuels.

It is a further object of the present invention to provide a dual fuel single injector nozzle that provides a precise amount of pilot fuel prior to the introduction of the coal/water slurry.

It is a further object of the present invention to provide a dual fuel single injector nozzle having a purged valve seat.

SUMMARY OF THE INVENTION

In one aspect of the present invention a dual fuel nozzle comprising a housing defining an interior bore, a first and second chamber, a slurry inlet and a pilot fuel inlet is provided. The first chamber is in flow communication with the slurry inlet and the second chamber is in flow communication with the pilot fuel inlet. A nozzle cup is secured to the housing. The nozzle cup defines a plurality of apertures extending from the interior of the nozzle cup to the exterior. The nozzle cup is in flow communication with the first and second chambers. A plunger is slidably mounted in the bore and a portion of the plunger passes through the first chamber. One end of the plunger defines a valve which engages a seat defined by the housing. Bias means urge the valve towards the seat. The portion of the plunger passing through the first chamber has an increasing diameter in the direction away from the valve end. The valve is capable of three positions depending on the pressure of the slurry in the first chamber. The three positions are: a fully seated position preventing flow communication between the first chamber and the nozzle cup, and preventing flow communication between the second chamber and the nozzle cup; a partially seated position preventing flow communication between the first chamber and the nozzle cup and providing flow communication between the second chamber and the nozzle cup thereby allowing pilot fuel to flow and purge the seat; and a fully open position permitting flow communication between the first chamber and nozzle cup and flow communication between the second chamber and the nozzle cup thereby allowing slurry and pilot fuel to flow.

BRIEF DESCRIPTION OF THE DRAWING

The features of the invention believed to be novel are set forth with the particularity in the appended claims. The invention itself, however, both as to organization and method of operation, together with further objects and advantages thereof, may best be understood by reference to the following description taken in conjunction with the drawing in which:

DETAILED DESCRIPTION OF THE DRAWING

Figure 1:
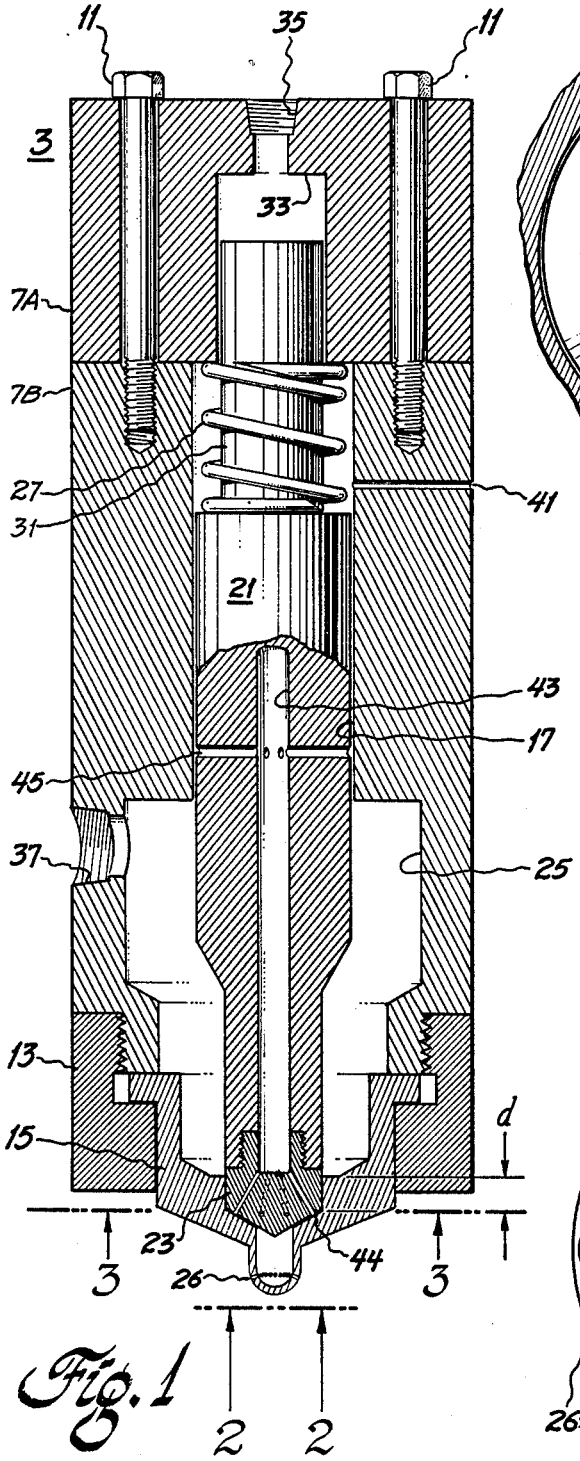
FIG. 1 is a cross sectional view of a single fuel nozzle in accordance with the present invention.
Figure 3:
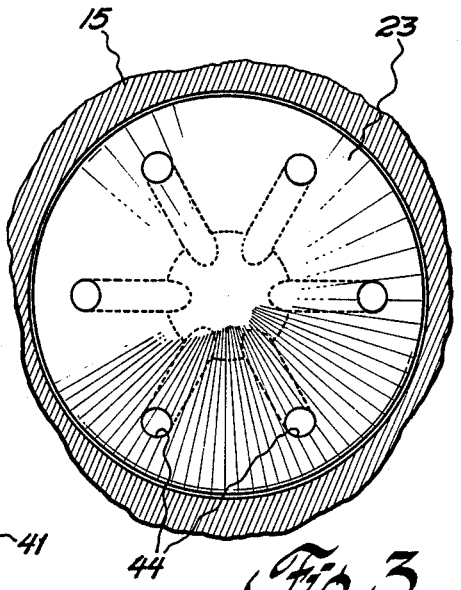
FIG. 3 is an enlarged view of the valve end of the plunger of FIG. 1 along the lines 3—3.
Figure 2:
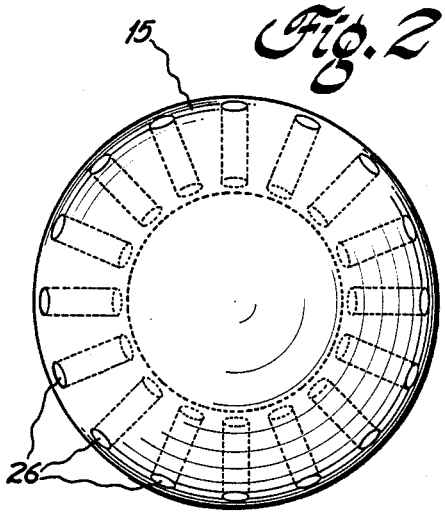
FIG. 2 is an enlarged view of the nozzle cup of FIG. 1 along the lines 2—2.

Referring now to the drawing and more particularly FIG. 1 thereof, a dual fuel injector nozzle 3 is shown. The injector nozzle comprises several parts which are stationary and are referred to collectively as the housing. The housing comprises a valve body having a cylindrical upper and lower portion 7A and 7B, respectively, joined by a ring of bolts 11 passing through the upper portion of the valve body and threadingly engaging the lower portion. A threaded cap 13, defining a central aperture, threadingly engages the bottom portion of the lower valve body capturing an injector cup 15 at the bottom portion of the lower valve body 7B. The injector cup 15 extends through the central aperture of the threaded cap 13. The housing parts 7A, 7B, 13 and 15 can be fabricated from stainless steel. The valve body 7A and 7B defines a longitudinally extending bore 17, in which a plunger 21 is slidably situated. The plunger, which also can be fabricated from stainless steel, has a cylindrical portion with a tapered end functioning as a valve 23, engageable with a seat which is part of the inside of the nozzle cup 15. The seat is formed as a cylindrical aperture into which the cylindrical portion of the valve snuggly fits and a tapered seat portion that the tapered portion of the valve engages. The valve 23 is shown as having a cylindrical body with a tapered tip which threadingly engages the end of the plunger. A separate valve section permits the use of the highly abrasion resistant steel, steel alloy or ceramic. The valve 23 when engaged with the seat, closes off a passageway leading from a chamber 25, surrounding the lower portion of the plunger 21, to the interior of the injector cup 15. The injector cup defines a plurality of spray orifices 26 which extend into a combustion chamber (not shown). The spray orifices are circumferentially arranging with 10–32 orifices equally spaced as can be seen in FIG. 2. Orifices on opposite sides typically form an angle of 150–160°.

The lower portion of the plunger, situated in chamber 25, has an increasing diameter in the direction moving away from the valve end of the plunger. The plunger is biased towards its seat by a helical spring 27 which surrounds a stem portion 31 extending from the plunger on the end opposite the valve. The stem portion has a diameter smaller than the plunger. The spring 27 is compressed between the top of the plunger and the upper portion of the valve body 7A through which the stem passes. A chamber point 33 in the upper portion of the valve body is located above the end of the stem portion 31. Pilot fuel can be introduced to the chamber above the stem portion through a threaded inlet aperture 35 communicating with the outside of the valve body. Coal/water slurry can be introduced through a threaded inlet aperture 37 to the chamber 25 surrounding the lower portion of the plunger 7B. The area where the spring is located communicates with a purge aperture 41 extending to the outside of the valve body. The plunger, including the stem portion, defines a central passageway 43 that extends from the end of the stem portion through the plunger and ends in a plurality of circumferentially spaced apertures 44 in the valve 23, in flow communication with the central passageway 43. The plurality of apertures 44 are situated such that when the tapered end of the valve engages the tapered portion of the seat, the apertures are covered by the seat. The central passageway 43 is also in flow communication with the plurality of apertures 45 which extend radially to the outside of the plunger. Pilot fuel from chamber 33 can flow out the radial apertures and wash the walls of any slurry from the slurry chamber 25.

In operation, pilot fuel which can comprise diesel fuel and coal/water slurry are provided to their respective inlets with the pilot fuel maintained a pressure slightly higher than the coal/water slurry. The pilot fuel and coal/water slurry have to be supplied at high pressure so that the pilot fuel and coal/water slurry can be sprayed into a combustion during the compression stroke. This can be acomplished by a diaphragm pump such as the one shown in U.S. Pat. No. 4,634,351, filed Oct. 31, 1985, entitled, "Diaphragm Pump" filed by Leonard and Johnson, assigned to the instant assignee and hereby incorporated by reference. When the pressure of the coal/water slurry and pilot fuel is increased, the coal/water slurry in the chamber acts on the increasing diameter of the plunger overcoming the bias of the spring and the pressure of the pilot fuel in the reservoir, causing the tapered portion of the valve to lift from its tapered seat and provide pilot fuel to the injector cup 15, from where it can be sprayed into the combustion chamber. As the plunger continues to lift, the cylindrical portion of the valve is slidable removed from its cylindrical seat allowing slurry to flow to the combustion chamber past the seat and through the injector cup. The distance shown by letter "d" in FIG. 1 is the depth of the cylindrical portion of the valve seat which determines the amount of pilot fuel that is admitted prior to the introduction of slurry. When the coal/water slurry pressure decreases, the plunger moves towards its seat stopping the flow of slurry. The pilot fuel continues to flow cleaning the seat area to remove coal/water slurry and assuring a tight closure when the tapered end of the valve contacts the tapered end of the seat. The amount of pilot fuel injected during full load conditions is typically 2–5 % of the heating value of the coal/water slurry with a maximum value of 10%. The purge aperture can be coupled to the pilot fuel supply to allow any pilot fuel that seeps past the plunger to drain back. The purge aperture could also be used to supply gas under pressure to provide a gas spring eliminating the need for the helical spring.

Figure 4:
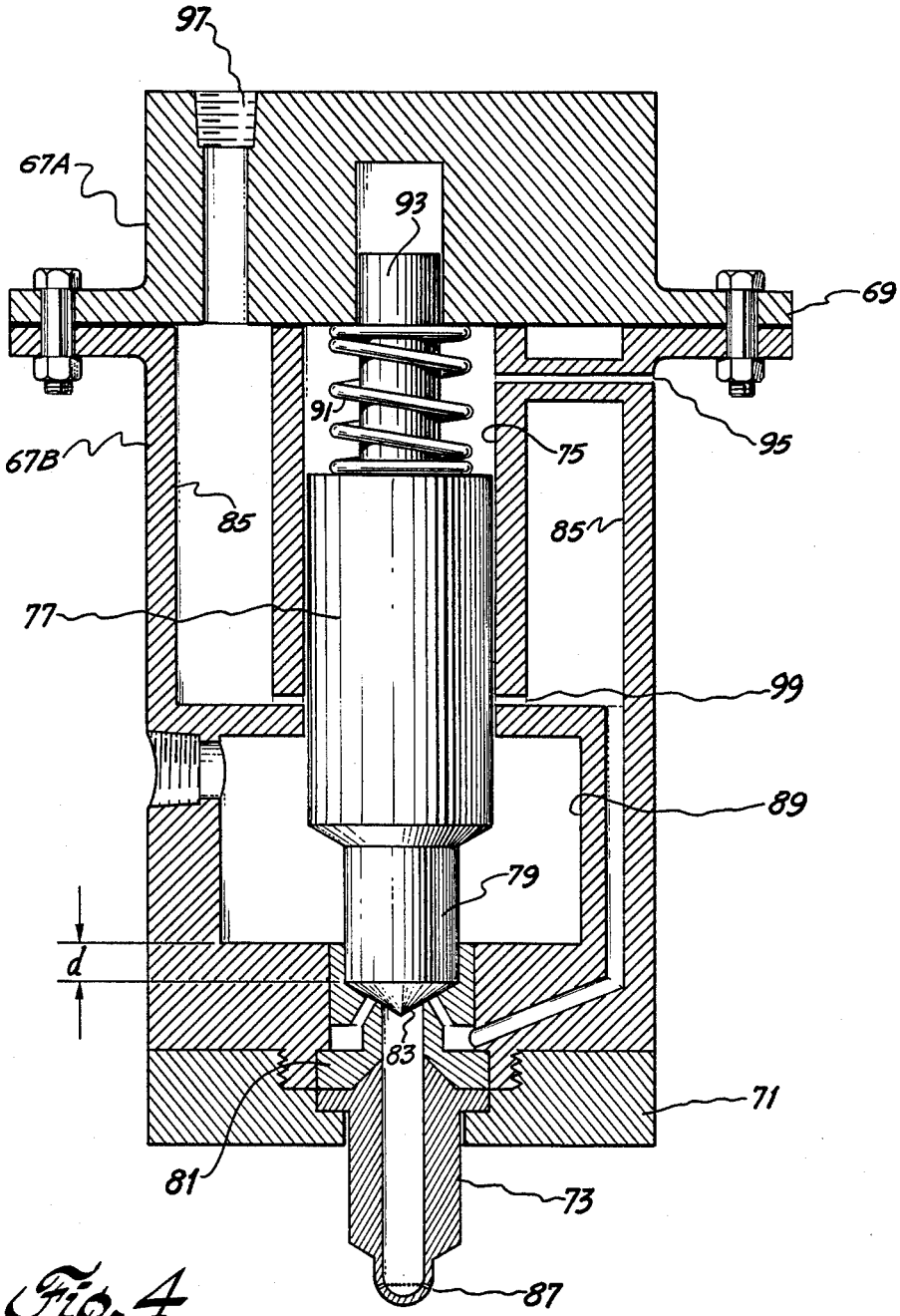
FIG. 4 is a cross sectional view of another embodiment of a single fuel nozzle in accordance with the present invention.

Another embodiment of the present invention is shown in FIG. 4. The arrangement is similar to that of FIG. 1 except that the plunger contains no passageways and the pilot fuel is introduced through the valve seat. The injector comprises several parts which are stationary and are referred to collectively as the housing. The housing comprises a valve body having a cylindrical upper and lower portion 67A and 67B, respectively, joined by flanges 69 extending from the periphery of the valve body. A threaded cap 71 defining a central aperture, threadingly engages the bottom portion of the lower valve body capturing an injector cup 73 at the bottom portion of the lower valve body. An insert 81 is located in the bottom portion of the lower valve body above injector cup 73. The housing consists of parts 67A, 67B, 69, 71, 73 and 81. The housing parts 67A, 67B, 69, 71 and 73 can be fabricated from stainless steel. The valve body defines a longitudinally extending bore 75 in which a plunger 77 is slidably situated. The plunger, which also can be fabricated from stainless steel, has one end which serves as a valve 79 which is engageable with a seat which is part of insert 81. The valve 79 comprises a cylindrical portion with a tapered end. The seat is formed in the insert as a cylindrical aperture into which the cylindrical portion of the valve snuggly fits and a tapered portion that the tapered portion of the valve engages. The insert 81 has a plurality of circumferentially arranged apertures 83 which are in flow communication with a pilot fuel chamber 85 located in the valve body. When the valve is engaged with its seat, the apertures leading to the pilot fuel reservoir are closed off. The injector 73 cup defines a plurality of circumferentially arranged spray orifices 87 which extend from the interior of the cup to the exterior. The spray orifices can be arranged as described in FIG. 1. The injector cup portion is typically situated in a combustion chamber (not shown).

The lower portion of the plunger which is situated in a slurry chamber 89, has an increasing diameter in the direction moving away from the valve end. The plunger is biased towards its seat by a helical spring 91 which surrounds a stem portion 93 extending from the plunger on the end of the plunger opposite the valve end. The stem portion has a diameter smaller than the plunger. The spring 91 is compressed between the top of the plunger and the upper portion of the valve body into which the stem extends. A purge aperture 95 extends from the interior of the valve body where the spring is located to the outside of the valve body.

The pilot fuel chamber 85 receives fuel from a threaded pilot fuel inlet port 97. Pilot fuel from the chamber is supplied to circumferentially spaced apertures 99 extending into the bore surrounding the plunger, above the slurry chamber, to purge the walls of coal/water slurry from the chamber below. The coal/water slurry chamber 89 is in flow communication with a threaded aperture where coal/water slurry can be supplied.

In operation, pilot fuel and coal/water slurry are provided to their respective inlets with the pilot fuel maintained at a pressure slightly higher then the coal/water slurry. This can be accomplished by a diaphragm pump as described in connection with FIG. 1. When the pressure of the coal/water slurry and pilot fuel are increased, the coal/water slurry in the chamber acts on the increasing diameter of the plunger overcoming the bias of the spring 91, causing the tapered portion of the valve to lift from its tapered seat and provide pilot fuel to the injector cup 73 where it is sprayed into the combustion chamber. As the plunger 77 continues to lift, the cylindrical portion of the valve is slidably removed from its cylindrical seat, allowing slurry from the chamber to flow to the combustion chamber by flowing past the seat and through the injector cup. The distance shown as letter "d", is the depth of the cylindrical portion of the valve seat and determines the amount of pilot fuel admitted prior to the introduction of coal/water slurry. When the coal/water slurry pressure decreases, the plunger moves towards the seat stopping the flow of coal/water slurry and the pilot fuel purges the seat area so that a tight closure can be made when the tapered end of the valve is seated.

The foregoing has described a dual fuel single injector nozzle for use with slurry fuels that provides a precise amount of pilot fuel prior to the introduction of coal/water slurry and which purges the valve seat after the slurry is introduced.

While the foregoing has been disclosed with reference to several preferred embodiments thereof, it will be clear to those skilled in the art that various changes in form and details may be made therein without departing from the spirit and scope of the invention.

What is claimed is:

1. A dual fuel nozzle comprising:

a housing defining an interior bore, a first and second chamber, a coal/water slurry inlet port and a pilot fuel inlet port, said first chamber in flow communication with the coal/water slurry inlet port and the second chamber in flow communication with the pilot fuel inlet port.

said housing further including a nozzle cup, said nozzle cup defining a plurality of apertures extending from the interior of the nozzle cup to the exterior of the nozzle cup, said nozzle cup in flow communication with said first and second chambers;

bias means; and a plunger slidably mounted in said bore, a portion of said plunger passing through said first chamber, one end of said plunger defining a valve, the valve engageable with a seat defined by said housing, said bias means urging said valve towards said seat, a portion of said plunger passing through said first chamber having an increasing diameter in a direction away from the valve end, said valve capable of three positions depending on the pressure of said slurry in said first chamber, a fully seated position preventing flow communication between said first chamber and said nozzle cup and preventing flow communication between said second chamber and said nozzle cup, a partially seated position preventing flow communication between said first chamber and said nozzle cup and permitting flow communication between said second chamber and said nozzle cup thereby allowing pilot fuel to flow and purge said seat of slurry, and a fully open position permitting flow communication between said first chamber and the nozzle cup and said second chamber and said nozzle cup, thereby allowing slurry fuel and pilot fuel to flow.

2. The nozzle of claim 1 wherein said plunger defines a central passageway providing flow communication between said second chamber and the valve, the valve providing a plurality of apertures that are closed off when said valve is fully seated.

3. The nozzle of claim 2 wherein said plunger defines radial passageways extending from the central passageway to the exterior of the plunger to purge the bore above the first chamber.

4. The nozzle of claim 1 wherein said seat defines a plurality of apertures in flow communication with said second chamber, the valve covering said apertures when the valve is fully seated.

5. The nozzle of claim 4 wherein said seat defines a plurality of passageways providing flow communication from the second chamber to the bore above said first chamber to purge the bore above said first chamber.

* * * * *